US009140086B2

(12) United States Patent
Hall

(10) Patent No.: US 9,140,086 B2
(45) Date of Patent: Sep. 22, 2015

(54) DOWNHOLE APPARATUS

(75) Inventor: Robert Neil Hall, Aberdeen (GB)

(73) Assignee: Wireline Engineering Limited, Aberdeen (GB)

( * ) Notice: Subject to any disclaimer, the term of this patent is extended or adjusted under 35 U.S.C. 154(b) by 233 days.

(21) Appl. No.: 13/879,482

(22) PCT Filed: Oct. 12, 2011

(86) PCT No.: PCT/GB2011/001471

§ 371 (c)(1), (2), (4) Date: Apr. 22, 2013

(87) PCT Pub. No.: WO2012/049456

PCT Pub. Date: Apr. 19, 2012

(65) Prior Publication Data

US 2013/0213670 A1 Aug. 22, 2013

(30) Foreign Application Priority Data

Oct. 14, 2010 (GB) ..... 1017309.4

(51) Int. Cl.
*E21B 23/03* (2006.01)

(52) U.S. Cl.
CPC ..... *E21B 23/03* (2013.01)

(58) Field of Classification Search
CPC ..... E21B 23/03
See application file for complete search history.

(56) References Cited

U.S. PATENT DOCUMENTS

| | | | | |
|---|---|---|---|---|
| 3,837,398 | A | 9/1974 | Yonker | |
| 4,026,363 | A * | 5/1977 | Yonker et al. | 166/381 |
| 4,294,313 | A | 10/1981 | Schwegman | |
| 4,442,893 | A * | 4/1984 | Foust | 166/117.5 |
| 4,624,309 | A | 11/1986 | Schnatzmeyer | |
| 4,828,027 | A * | 5/1989 | Schnatzmeyer | 166/117.5 |
| 4,846,269 | A * | 7/1989 | Schnatzmeyer | 166/65.1 |
| 2006/0159400 | A1 * | 7/2006 | Richards et al. | 385/53 |

FOREIGN PATENT DOCUMENTS

| | | | |
|---|---|---|---|
| WO | 9826154 | A1 | 6/1998 |
| WO | 2008118022 | A1 | 10/2008 |

OTHER PUBLICATIONS

International Search Report—International Application No. PCT/GB2011/001471.

* cited by examiner

*Primary Examiner* — William P Neuder
(74) *Attorney, Agent, or Firm* — Gifford, Krass, Sprinkle, Anderson & Citkowski, P.C.

(57) ABSTRACT

A downhole apparatus for depositing a tool in a side pocket mandrel is described. The apparatus comprises an apparatus body, a tool holder and a displacement mechanism for connecting the tool holder to the apparatus body. The tool holder is movable between a run-in position, in which the tool holder is adjacent the body, to a displaced position, in which the tool holder is spaced away from the body. As a tool is moved between the run-in position and the displaced position, a tool longitudinal axis remains substantially parallel to an apparatus body longitudinal axis.

33 Claims, 3 Drawing Sheets

DOWNHOLE APPARATUS

CROSS-REFERENCE TO RELATED APPLICATIONS

This application is the U.S. National Phase of PCT/GB2011/001471 filed Oct. 12, 2011, which claims priority of Great Britain Patent Application 1017309.4 filed Oct. 14, 2010.

FIELD OF THE INVENTION

The present invention relates to a downhole apparatus and a method of operating a downhole apparatus. Particularly, the present invention relates to a downhole apparatus for setting and retrieving equipment from side pocket mandrels or similar devices.

BACKGROUND TO THE INVENTION

In oil and gas production there are operations in which communication between the tubing annulus and tubing is advantageous. For example, in circumstances where there is insufficient reservoir pressure to force hydrocarbons in the production tubing from the reservoir to the surface it is common practice to inject gas from the annulus into the hydrocarbon stream to reduce the density of hydrocarbons. When the density of hydrocarbons is reduced, the reservoir pressure is then able to raise the column of hydrocarbons to surface. Access between the annulus and the production tubing is provided by a gas lift valve.

To prevent disruption to the flow of hydrocarbons and to ensure access is still possible to the wellbore and completion components below, gas lift valves, and similar devices that require communication with the annulus, are housed in side pocket mandrels. A side pocket mandrel is a section of tubing which has a pocket offset from the main production bore.

A number of devices for running the tools, such as gas lift valves, down to the side pocket mandrel are known. These devices, known as kick over tools, allow the valve, for example, to be run into the well and, once in position adjacent to the side pocket, deployed by displacing the leading end of the valve away from the kick over tool's body and into the side pocket entrance.

The displacement is activated by a trigger mechanism. The mandrel is provided with a recess for receiving the trigger mechanism. The trigger recess is positioned such that as long as the trigger is in the recess the kick over tool is positioned correctly relative to the side pocket.

To operate the kick over tool, the kick over tool is run-in to the well passed the trigger mechanism recess. The kick over tool is then pulled back into the recess. This pull also fires the trigger mechanism and kicks the leading end of the valve out from the kick over tool body and towards the side pocket entrance. The kick over tool is then lowered down the well, which in turn lowers the valve and sets it into the side pocket.

However, there are drawbacks associated with conventional kick over tools. For example, if the operator pulls back on the kick over tool and it is not located in the recess, there is the possibility that the trigger will be fired by contact with another part of the mandrel. The tool to be deployed, such as the gas lift valve, then kicks over but will not be positioned correctly relative to the side pocket and will not be able to be deployed in the side pocket.

Furthermore, the gas lift valve, for example, can be damaged as it works its way into the side pocket causing a certain amount of bending force to be applied to the valve as it is lowered in. As a result, the sealing packings on the gas lift valve and indeed sensitive internal components can be damaged.

SUMMARY OF THE INVENTION

According to a first aspect of the present invention there is provided a downhole apparatus for depositing a tool in a side pocket mandrel, the apparatus comprising:

an apparatus body;

a tool holder, the tool holder being movable between a run-in position, in which the tool holder is adjacent the body, to a displaced position, in which the tool holder is spaced away from the body;

a displacement mechanism for connecting the tool holder to the apparatus body;

wherein, in use, as a tool is moved between the run-in position and the displaced position, a tool longitudinal axis remains substantially parallel to an apparatus body longitudinal axis.

An apparatus in accordance with at least one embodiment of the present invention provides a downhole apparatus for depositing a tool in a side pocket mandrel in which the tool remains substantially parallel to the apparatus body during deployment. In most applications, the longitudinal axis of the mandrel side pocket will also be parallel to the apparatus longitudinal axis. In such an arrangement, the tool can be axially aligned with the mandrel side pocket prior to entry minimising the possibility of bending the tool and damaging the tool as it is deposited in the side pocket.

In a preferred embodiment, in use, the apparatus is adapted to align the tool longitudinal axis parallel to a mandrel side pocket longitudinal axis prior to entry into the mandrel side pocket.

In a preferred embodiment, once attached to the tool holder, the tool longitudinal axis is fixed with respect to the apparatus body longitudinal axis.

The tool holder may be biased to the displaced position.

The displacement mechanism may be biased to the displaced position.

The tool holder may be pivotally attached to the displacement mechanism.

The displacement mechanism may be pivotally attached to the apparatus body.

The displacement mechanism may be pivotally attached to the apparatus body in more than one location.

The displacement mechanism may be pivotally attached to the apparatus body in two locations.

The tool holder may be pivotally attached to the displacement mechanism in two locations.

The displacement mechanism may comprise at least one member.

The/each member may be an elongated member.

The displacement mechanism may comprise a first member and a second member.

The first member may have an upper pivot attachment to the apparatus body and a lower pivot attachment to the tool holder, and the second member may have an upper pivot attachment to the apparatus body and a lower pivot attachment to the tool holder In the run-in position the first member upper pivot attachment may be directly above the first member lower pivot attachment and the second member upper pivot attachment may be directly above the second member lower pivot attachment.

In the run-in position, the first member upper pivot attachment and the first member lower pivot attachment may lie on an axis parallel to the tool longitudinal axis.

In the run in position, the second member upper pivot attachment and the second member lower pivot attachment may lie on an axis parallel to the tool longitudinal axis At any position between the run-in position and the displaced position, the pivot attachments may describe a parallelogram.

At any position between and including the run-in position and the displaced position, the pivot attachments may describe a parallelogram.

The apparatus may comprise at least one biasing means to bias the displacement mechanism to the displaced position.

The/each biasing means may comprise at least one spring.

The/each biasing means may comprise at least one leaf spring.

Each displacement member may be associated with at least one leaf spring.

Each displacement member may be associated with a pair of leaf springs.

The/each biasing means may be pivotally mounted to a displacement member.

Where there is a pair of leaf springs, the springs may be arranged to push in opposite directions.

In an alternative embodiment the biasing means may comprise at least one coil spring or at least one hydraulic piston or the like.

In one embodiment, where the displacement mechanism comprises a first displacement member and the biasing means comprises a pair of springs, the springs may be positioned between a tool body surface and a displacement member surface, one spring arranged to press against the tool body surface and the other spring arranged to press against the displacement member surface. In this arrangement, the springs push the displacement member surface away from the tool body surface.

In an embodiment where there is a first displacement member and a second displacement member, a further biasing means, comprising a pair of springs, may be provided, the biasing means being arranged between a surface of the first displacement members and a surface of the second displacement members, one spring arranged to press against the first of said displacement member's surface and the other spring arranged to press against the second of said displacement member surfaces to push said surfaces apart.

The displacement mechanism may be restrained in the run-in position.

The apparatus may comprise a trigger device. A trigger device may be provided to actuate the displacement mechanism from the run-in position to the displaced position.

The trigger device may comprise a portion adapted to engage the displacement mechanism preventing the displacement mechanism pivoting towards the displaced position. When the trigger device is fired, the trigger device portion moves relative to the displacement mechanism, releasing the displacement mechanism and permitting the displacement mechanism to pivot towards the displaced position.

The tool holder may comprise an attachment point for releasably attaching a tool to the tool holder.

The attachment point may comprise a longitudinal recess having a longitudinal axis.

In one embodiment, the attachment point's longitudinal axis remains substantially parallel to an apparatus body longitudinal axis as the tool holder moves between the run-in position and the displaced position.

According to a second aspect of the present invention there is provided a method of depositing a tool in a side pocket mandrel, the method comprising the steps of:

moving a tool to a run-in position, the tool being attached to an apparatus comprising an apparatus body, a tool holder and a displacement mechanism, the displacement mechanism connecting the tool holder to the apparatus body, and displacing the tool holder to a displaced position in which the tool holder is spaced away from the body, the tool longitudinal axis remaining substantially parallel to an apparatus body longitudinal axis tool during movement between the run-in and displaced positions.

BRIEF DESCRIPTION OF THE DRAWINGS

An embodiment of the present invention will now be described with reference to the accompanying drawings in which.

DETAILED DESCRIPTION OF THE DRAWINGS

Figure 1:
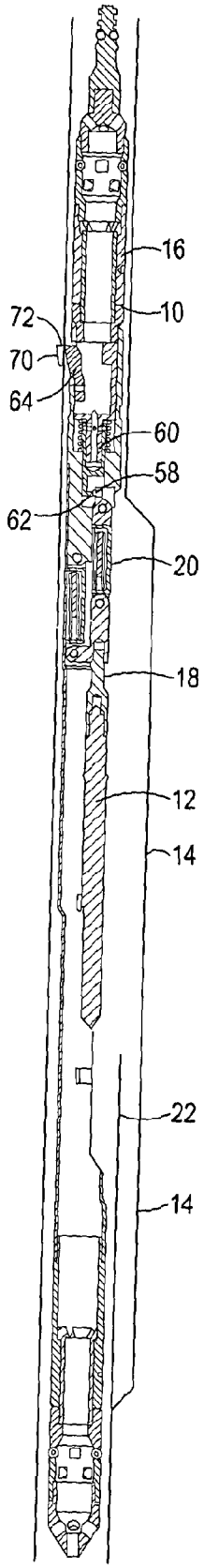
FIG. 1 is a section through a downhole apparatus for depositing a tool in a side pocket mandrel, the apparatus shown in a run-in position.

Reference is first made to FIG. 1, a section through a downhole apparatus, generally indicated by reference numeral 10, for depositing a tool 12 in a side pocket mandrel 14, the apparatus 10 being shown in a run-in position.

The apparatus 10, known as a kick over tool, comprises an apparatus body 16, a tool holder 18, and a displacement mechanism 20, the displacement mechanism 20 connecting the tool holder 18 to the apparatus body 16.

Figure 2:
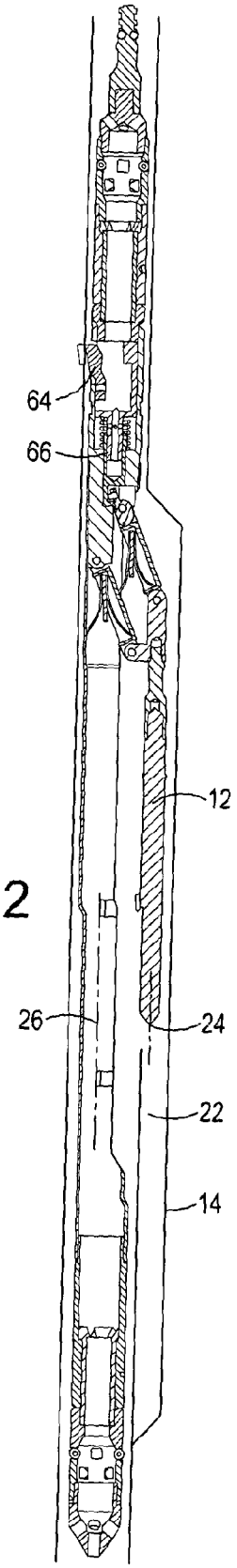
FIG. 2 is a section through the apparatus of FIG. 1 shown in the displaced position.

The displacement mechanism 20 is adapted to move the tool holder 18 from the run-in position (shown in FIG. 1), in which the tool holder 18 is adjacent the body 16, to a displaced position (shown in FIG. 2, a section through the downhole apparatus 10 of FIG. 1, shown in the displaced position). In the displaced position, the tool holder 18 is spaced away from the body 16, and the tool 12 is aligned with a side pocket 22 of the side pocket mandrel 14.

Referring to FIG. 2, the displacement mechanism 20 is arranged such that a tool longitudinal axis 24 remains substantially parallel to an apparatus body longitudinal axis 26 as the tool 12 is moved from the run-in position to the displaced position.

Figure 3:
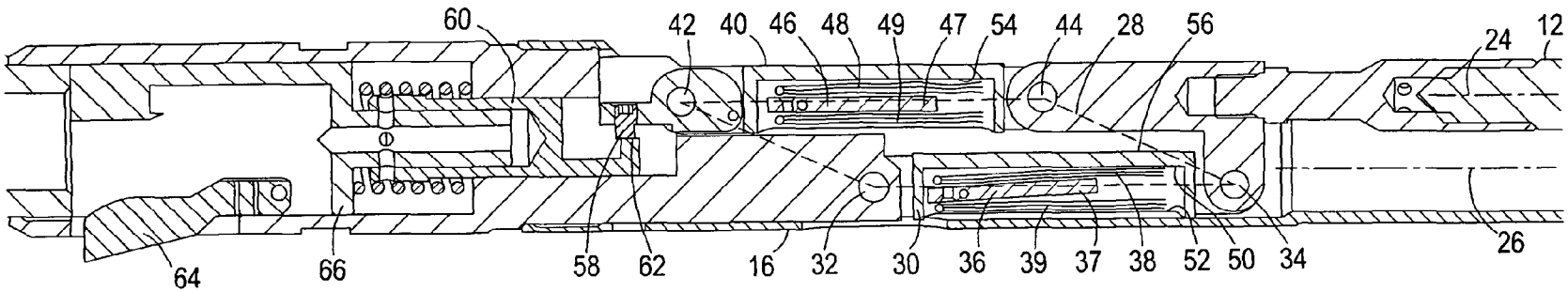
FIG. 3 is a close-up section of part of the apparatus of FIG. 1 shown in the run-in position.
Figure 4:
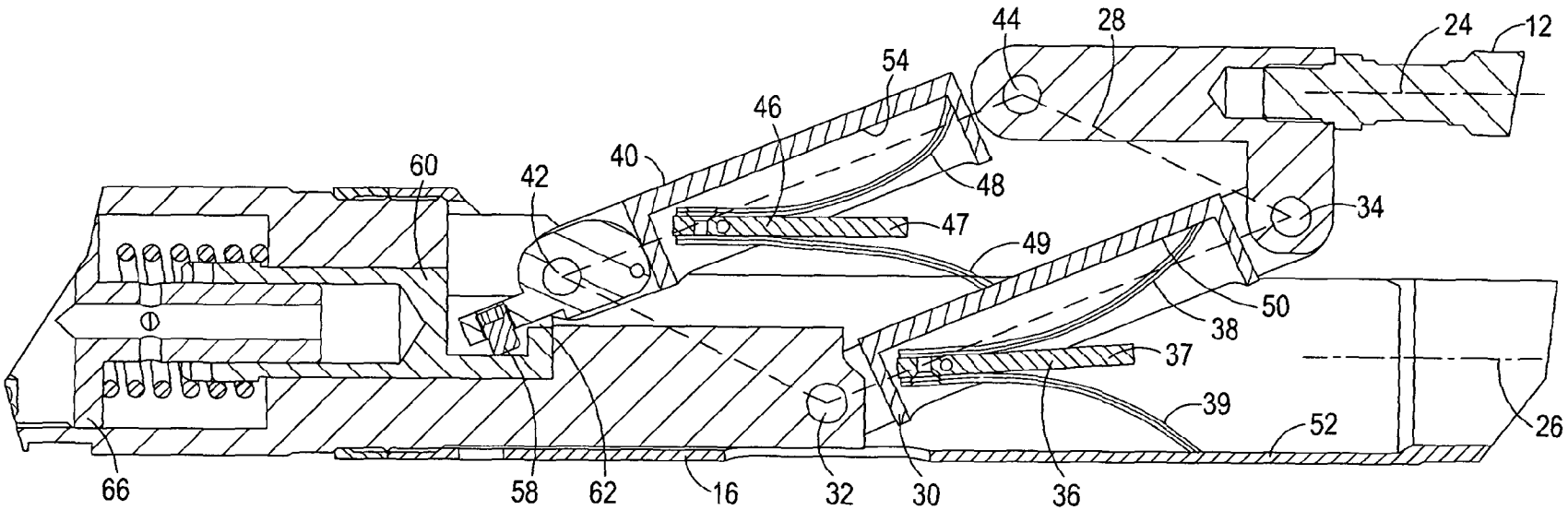
FIG. 4 is a close-up section of part of the apparatus of FIG. 1 is shown in the displaced position.

Referring to FIG. 3, a close-up section of the displacement mechanism 20 of the apparatus 10 of FIG. 1 in the run-in position, and FIG. 4, a close-up section of the displacement mechanism 20 of the apparatus 10 of FIG. 1 in the displaced configuration, the displacement mechanism 20 comprises a first displacement mechanism member 30 and a second displacement mechanism member 40. The first displacement mechanism member 30 is pivotally attached to the body 16 by an upper pin 32 and pivotally attached to the tool holder 18 by a lower pin 34. The second displacement mechanism member 40 is pivotally attached to the body 16 by an upper pin 42 and pivotally attached to the tool holder 18 by a lower pin 44.

The arrangement of the pins 32, 34, 42, 44 describes a parallelogram 28. It is this parallelogram 28 arrangement which maintains the tool longitudinal axis 24 substantially parallel to the apparatus body longitudinal axis 26 as the tool 12 is moved from the run-in position to the displaced position. The use of a parallelogram 28 and tool holder 18 permits the kick over tool 10 to still maintain the parallel relationship between the axes 24, 26 even in non-vertical wells.

The displacement mechanism 20 further comprises a first biasing means 36 and a second biasing means 46. The first and second biasing means 36, 46 are attached to the first and second displacement members 30, 40 respectively. Each biasing means 36, 46 includes a support 37, 47 and a pair of opposed leaf springs 38, 39, 48, 49, attached to the support 37, 47.

The biasing means 36, 46 are provided to bias the displacement mechanism and, in turn, the tool 12 and tool holder 18 to the displaced position. Referring to FIG. 4, in particular, one of the first biasing means springs 38 bears against an inner surface 50 of the first displacement member 30 and the other of the first biasing means springs 39 bears against an inner surface 52 of the apparatus body 16, the first biasing means springs 38, 39 pushing these surfaces 50, 52 apart. Similarly, one of the second biasing means springs 48 bears against an inner surface 54 of the second displacement member 40 and the other of the second biasing means springs 49 bears against an outer surface 56 of the first displacement member 30, the second biasing means springs 48, 49 pushing these surfaces 54, 56 apart.

Referring back to FIG. 3, the displacement mechanism 20 is retained in the run-in position by the interaction between a detente 58 extending from the second displacement member 40 and an apparatus trigger mechanism 60. Particularly the detente 58, in the run-in position, rests on, and is supported by, a surface 62 defined by the trigger mechanism 60.

The trigger mechanism 60 comprises a location arm 64 and an actuator 66, a lower end of the actuator 66 defining the support surface 62.

In use, when it is desired to deposit a tool 12 in the mandrel side pocket 22, the apparatus 10 is run in to the side pocket mandrel 14 to the position shown in FIG. 1. The side pocket mandrel 14 defines a recess 70 adapted to receive the locator arm 64. When the apparatus 10 is position, and the locator arm is located in the recess 70, a sharp pull on the tool 10 engages the locator arm 64 with the upper end of the recess 72 retaining the locator arm 64, such that the tool 10 moves with respect to the arm 64, bringing the arm 64 into engagement with the trigger 66. The arm 64 presses on the trigger 66 and the trigger 66 moves downwards, towards the displacement mechanism 20, which in turn removes the supporting surface 62 from behind the detente 58 allowing the displacement mechanism 20 to move from the run-in position shown in FIG. 1 and FIG. 3 to the displaced position shown in FIG. 2 and FIG. 4 under the action of the first and second biasing means 36, 46.

In this position the tool 12 can then be deposited in the side pocket mandrel 22 with minimal, if any, damage to the tool as the tool longitudinal axis 24 is aligned with the axis of the side pocket 22. To deposit the tool 12 inside the pocket 22 the apparatus 10 is lowered further downhole and the tool 12 is lowered into the side pocket 22.

Various modifications and improvements may be made to the above described embodiment without departing from the scope of the invention. For example, although the biasing means 36, 46 incorporate leaf springs, in alternative embodiments, they could utilise coil springs, electrical or mechanical actuators, hydraulic pistons, or any suitable method of displacing the tool holder 18.

The invention claimed is:

1. A downhole apparatus for depositing a tool in a side pocket mandrel, the apparatus comprising:

an apparatus body;

a tool holder, the tool holder being movable between a run-in position, in which the tool holder is adjacent the apparatus body, to a displaced position, in which the tool holder is spaced away from the body;

a displacement mechanism for connecting the tool holder to the apparatus body;

wherein, in use, as a tool is moved between the run-in position and the displaced position, a tool longitudinal axis remains substantially parallel to an apparatus body longitudinal axis, wherein the displacement mechanism comprises a first member and a second member, and the first member has an upper pivot attachment to the apparatus body and a lower pivot attachment to the tool holder, and the second member has an upper pivot attachment to the apparatus body and a lower pivot attachment to the tool holder.

2. The downhole apparatus of claim 1, wherein, in use, the apparatus is adapted to align the tool longitudinal axis parallel to a mandrel side pocket longitudinal axis prior to entry into the mandrel side pocket.

3. The downhole apparatus of claim 1, wherein, once attached to the tool holder, the tool longitudinal axis is fixed with respect to the apparatus body longitudinal axis.

4. The downhole apparatus of claim 1, wherein the tool holder is biased to the displaced position.

5. The downhole apparatus of claim 1, wherein the displacement mechanism is biased to the displaced position.

6. The downhole apparatus of claim 1, wherein the displacement mechanism is pivotally attached to the apparatus body.

7. The downhole apparatus of claim 1, wherein the displacement mechanism is pivotally attached to the apparatus body in more than one location.

8. The downhole apparatus of claim 1, wherein the displacement mechanism is pivotally attached to the apparatus body in two locations.

9. The downhole apparatus of claim 1, wherein the tool holder is pivotally attached to the displacement mechanism.

10. The downhole apparatus of claim 9, wherein the tool holder is pivotally attached to the displacement mechanism in two locations.

11. The downhole apparatus of claim 1, wherein the displacement mechanism comprises at least one member.

12. The downhole apparatus of claim 11, wherein the/each member is an elongated member.

13. The downhole apparatus of claim 1, wherein, in the run-in position, the first member upper pivot attachment is directly above the first member lower pivot attachment and the second member upper pivot attachment is directly above the second member lower pivot attachment.

14. The downhole apparatus of claim 13, wherein, in the run-in position, the first member upper pivot attachment and the first member lower pivot attachment lies on an axis parallel to the tool longitudinal axis.

15. The downhole apparatus of claim 13, wherein, in the run in position, the second member upper pivot attachment and the second member lower pivot attachment lies on an axis parallel to the tool longitudinal axis.

16. The downhole apparatus of claim 13, wherein at any position between the run-in position and the displaced position, the pivot attachments describe a parallelogram.

17. The downhole apparatus of claim 13, wherein at any position between and including the run-in position and the displaced position, the pivot attachments describe a parallelogram.

18. The downhole apparatus of claim 1, wherein the apparatus comprises at least one biasing means to bias the displacement mechanism to the displaced position.

19. The downhole apparatus of claim 18, wherein the/each biasing means comprises at least one spring.

20. The downhole apparatus of claim 19, wherein the/each biasing means comprises at least one leaf spring.

21. The downhole apparatus of claim 20, wherein each displacement member is associated with at least one leaf spring.

22. The downhole apparatus of claim 21, wherein each displacement member is associated with a pair of leaf springs.

23. The downhole apparatus of claim 22, wherein where there is a pair of leaf springs, the springs are arranged to push in opposite directions.

24. The downhole apparatus of claim 18, wherein the biasing means comprises at least one coil spring or at least one hydraulic piston.

25. The downhole apparatus of claim 1, wherein the displacement mechanism is restrained in the run-in position.

26. The downhole apparatus of claim 1, wherein the apparatus comprises a trigger device.

27. The downhole apparatus of claim 26, wherein the trigger device comprises a portion adapted to engage the displacement mechanism preventing the displacement mechanism pivoting towards the displaced position.

28. The downhole apparatus of claim 27, wherein the attachment point comprises a longitudinal recess having a longitudinal axis.

29. The downhole apparatus of claim 28, wherein the attachment point's longitudinal axis remains substantially parallel to an apparatus body longitudinal axis as the tool holder moves between the run-in position and the displaced position.

30. A downhole apparatus for depositing a tool in a side pocket mandrel, the apparatus comprising:

an apparatus body;

a tool holder, the tool holder being movable between a run-in position, in which the tool holder is adjacent the apparatus body, to a displaced position, in which the tool holder is spaced away from the body;

a displacement mechanism for connecting the tool holder to the apparatus body;

wherein, in use, as a tool is moved between the run-in position and the displaced position, a tool longitudinal axis remains substantially parallel to an apparatus body longitudinal axis, wherein the apparatus comprises at least one biasing means to bias the displacement mechanism to the displaced position, and the/each biasing means is pivotally mounted to a displacement member.

31. A downhole apparatus for depositing a tool in a side pocket mandrel, the apparatus comprising:

an apparatus body;

a tool holder, the tool holder being movable between a run-in position, in which the tool holder is adjacent the apparatus body, to a displaced position, in which the tool holder is spaced away from the body;

a displacement mechanism for connecting the tool holder to the apparatus body;

wherein, in use, as a tool is moved between the run-in position and the displaced position, a tool longitudinal axis remains substantially parallel to an apparatus body longitudinal axis, wherein the apparatus comprises at least one biasing means to bias the displacement mechanism to the displaced position, and where the displacement mechanism comprises a first displacement member and the biasing means comprises a pair of springs, the springs are positioned between a tool body surface and a displacement member surface, one spring arranged to press against the tool body surface and the other spring arranged to press against the displacement member surface.

32. The downhole apparatus of claim 31, wherein where there is a first displacement member and a second displacement member, a further biasing means, comprising a pair of springs, is provided, the biasing means being arranged between a surface of the first displacement members and a surface of the second displacement members, one spring arranged to press against the first of said displacement member's surface and the other spring arranged to press against the second of said displacement member surfaces to push said surfaces apart.

33. A method of depositing a tool in a side pocket mandrel comprising the steps of:

moving a tool to a run-in position, the tool being attached to an apparatus, the apparatus comprising:

an apparatus body, a tool holder and a displacement mechanism, the displacement mechanism connecting the tool holder to the apparatus body, the displacement mechanism comprising a first member and a second member, the first member having an upper pivot attachment to the apparatus body and a lower pivot attachment to the tool holder, and the second member having an upper pivot attachment to the apparatus body and a lower pivot attachment to the tool holder, and wherein in the run-in position the tool holder is adjacent the apparatus body, and displacing the tool holder to a displaced position in which the tool holder is spaced away from the body, the tool longitudinal axis remaining substantially parallel to an apparatus body longitudinal axis tool during movement between the run-in and displaced positions.

* * * * *